United States Patent [19]

Wu

[11] 4,420,214

[45] Dec. 13, 1983

[54] ELECTRICAL PLUG AND SOCKET HAVING REPLACEABLE OVERCURRENT-PROTECTION DEVICE PROVIDED WITH SAFETY LATCH MEANS

[76] Inventor: Jeng-Shyong Wu, No. 133 Tungshing Rd., Toufun, Maulii, Taiwan

[21] Appl. No.: 121,324

[22] Filed: Feb. 14, 1980

[51] Int. Cl.[3] ..... H01R 13/06

[52] U.S. Cl. ..... 339/147 P; 337/198; 339/159 C

[58] Field of Search ..... 339/147 R, 147 P, 159 R, 339/159 C; 337/198, 197, 201, 211, 256, 263, 264

[56] References Cited

U.S. PATENT DOCUMENTS

| | | | |
|---|---|---|---|
| 2,496,413 | 2/1950 | Sciara | 337/263 |
| 2,640,125 | 5/1953 | Eggers | 339/159 C X |
| 2,668,885 | 2/1959 | Gerlat | 339/159 X |
| 2,728,828 | 12/1955 | Mason | 339/147 R |
| 3,699,500 | 10/1972 | Borzoni et al. | 339/147 P X |
| 4,178,061 | 12/1979 | Ahroni | 337/211 X |

FOREIGN PATENT DOCUMENTS

| | | | |
|---|---|---|---|
| 684,110 | 12/1952 | United Kingdom | 339/159 C |

*Primary Examiner*—Eugene F. Desmond
*Attorney, Agent, or Firm*—Kalish & Gilster

[57] ABSTRACT

An electrical plug or socket having a replaceable overcurrent-protection device positioned within the plug or socket body. There is provided a safety latch means including a latch member adapted to be inserted into the plug or socket body to protect, to shield, to hold, to pass through, to engage or to affix the overcurrent-protection device or a base carrying the overcurrent-protection device, so as to prevent the overcurrent-protection device from being removed or slipping off, to improved the contact performance between the overcurrent-protection device and the contact terminals for connecting the overcurrent-protection device into a circuit, and thus to realize the maximum degree of safety of the electrical plug or socket. The safety latch means can be readily removed from the plug or socket for quick and inexpensive replacement of the overcurrent-protection device. The electrical plug or socket according to this invention is convenient and safe being especially adapted for an unskilled person to use, constituting an advantageous electrical connection device for being plugged into a receptacle or, as a socket, receiving another plug.

7 Claims, 29 Drawing Figures

ELECTRICAL PLUG AND SOCKET HAVING REPLACEABLE OVERCURRENT-PROTECTION DEVICE PROVIDED WITH SAFETY LATCH MEANS

BACKGROUND OF THE INVENTION

1. Field of the Invention

This invention relates to electrical plugs and sockets, and more particularly to an electrical plug or socket having a replaceable overcurrent-protection device provided with safety latch means.

2. Description of the Prior Art

The structure of an electrical plug or socket, having a replaceable overcurrent-protection device as well as its electric circuit components is designed to have the overcurrent-protection device located in a position intermediate the copper prong members of the plug or the copper contact blades of the socket and an extension electrical conductor or electrical equipment when in use. Power supply is connected to one end of the overcurrent-protection device via the copper prong member or the copper contact blade; with, another end of the overcurrent-protection device being connected to the extension electrical conductor or the electrical equipment to complete an electric circuit. As an overload current or a short circuit occurs, the overcurrent-protection device blows out and the electric circuit is cut off without delay. The electric circuit will resume operation after the fault is rectified and the overcurrent-protection device is replaced with a new one. The functioning of such device is well-known in the art and further detailed explanation will be omitted here for simplification. However, conventional plugs or sockets, usually, cannot meet the safety requirement, and this problem still remains to be solved. Therefore, taking into consideration the safe use of electrical equipment, the damage of electrical equipment caused by an overload, the danger resulted from a short circuit or an electrical shock due to the exposure of a bare conductor in the circuit and the requirement of security of human life and property etc., the fundamental requirement of safety should be the primary consideration when designing and constructing an electrical plug or socket. In addition, from the viewpoint of convenience and utility, it is necessary to provide the plug or socket with an overcurrent-protection, and it is also necessary that the overcurrent-protection device can be replaced after its breakdown due to improper use or any other causes so that the plug or socket can resume its function after the fault is rectified. However, conventional plugs or sockets are not satisfactory from a safety standpoint. There are many disadvantages in conventional plugs and sockets. For example, the opening for fitting and removing the overcurrent-protection device is too large so that misuse may occur frequently with the incidence of great danger of electric shock by accidentally touching the live parts via the opening. The enclosure cover thereof tends to be easiily deformed causing it to fall off so that the bare conductor within the plug or socket will be exposed. The construction is complicated and the manufacturing cost is relatively quite high.

SUMMARY OF THE INVENTION

To eliminate the above-mentioned disadvantages of conventional construction, this invention provides an electrical plug or socket having a replaceable overcurrent-protection device positioned within the plug or socket body. There is provided a safety latch means including a latch member adapted to be inserted into the plug or socket body to protect, to shield, to hold, to pass through, to engage or to affix the overcurrent-protection device or a base carrying the same, so as to prevent the overcurrent-protection device from being removed or accidentially slipping off, to improve the contact performance between the overcurrent-protection device and the contact terminals for connecting the overcurrent-protection device into a circuit, and thus to realize the maximum degree of safety of the electrical plug or socket. The safety latch means can be readily removed from the plug or socket for quick and inexpensive replacement of the overcurrent-protection device. The electrical plug or socket according to this invention is convenient and safe, especially for an unskilled person to use.

At the front end of the insulating plug or socket body which is adjacent to the prong member or contact blade of the plug or socket, there is provided an opening or hole of suitable shape for fitting and removing the safety latch means. The direction in which the safety latch means is inserted into or removed from the insulating body is parallel to the direction in which the related prong member or contact blade extends. Specifically, the removal direction of the safety latch means is the same as the direction in which the prong member or contct blade of the plug or socket is inserted into a mating socket or plug of a power source, and the direction in which the safety latch means is inserted into the insulating body is in the same direction as that in which the prong member or contact blade of the plug or socket is removed from the mating socket or plug of the power supply. Thus, when it is desired to replace the overcurrent-protection device, the plug or socket has to be removed and separated from the mating socket or plug of the power source in order to remove the safety latch means to effect the replacement of the overcurrent-protection device. There is only the suitably shaped opening of minimum size on the surface of the insulating body of the plug or socket for fitting and removing the overcurrent-protection device, and said opening is shielded and closed by the safety latch means, or alternatively, said opening is blocked and closed by the base of the overcurrent-protection device, so that access to the inside of the insulating body is prevented. There is no hole or opening on the lateral surface of the insulating body except that the safety latch means has a portion exposed outside the insulating body in the direction of the prong member or contact blade. There is no exposure of electrical conductor except the prong member. Thus, the plug or socket according to this invention represents a maximum degree of safety.

The safety latch means according to this invention may be of electrically insulating material in plate shape so that it may be placed in direct contact with an electrical conductor. Otherwise, the safety latch means may be of non-insulating material in circular or cylindrical shape so that it may be isolated or provide a suitable gap or separation from the electrical conductor so as to satisfy the safety requirement.

Preferably, the length of the safety latch means is greater than that of the prong member of the plug with which the safety latch means is to be combined, or in case the safety latch means is to be incorporated with a socket, the length of the safety latch means is greater than that of the prong member of the plug with which the socket is to be noted. Thus, when replacement of the overcurrent-protection device is desired, the plug or socket has to be entirely removed and separated from the mating socket or plug of the power supply prior to the withdrawal of the safety latch means so that the latter can be removed for fitting a new overcurrent-protection device, and this provides absolute security for the user.

The safety latch means may be made in various forms depending on the structure, size, shape and usage conditions of the plug or socket and the replaceable overcurrent-protection device. For example, the safety latch means may be made in an integral plate shape, a forked shape, or in U-shaped configuration with a circular or cylindrical cross section at its leg. Alternatively, the safety latch means can be designed such that the overcurrent-protection device is directly attached to the safety latch means. All of these will be identical in their functioning and safety.

Further, the safety latch means may include engaging means such as, a projected or recessed portion, a bent portion or a tapered portion which, when being fitted in position, will engage with a recessed or projected portion, a bent portion or a tapered portion of the insulating body of the plug or socket, the terminal contact, or connection terminals within the plug or socket, so as to prevent the safety latch means against inadvertent displacement and to hold the overcurrent-protection device in position to improve the contact performance between the overcurrent-protection device and the connected circuit.

The main advantages and features of this invention are summarized as follows: the plug or socket according to the invention possesses the advantages of conventional plugs and sockets with or without a replaceable or non-replaceable overcurrent-protection device. The structure of the plug or socket according to this invention represents minimum or no possibility of exposing a bare conductor. In conventional plugs or sockets with an overcurrent-protection device, it is necessary to provide on the lateral side of the plug or socket body a relatively large hole or opening for fitting and removing said overcurrent-protection device and a door cover for shutting such hole or opening. On the contrary, the plug or socket of this invention is provided with an opening of minimum size for fitting and removing said overcurrent-protection device; even the lateral side of the insulating body of the plug or socket does not have any opening or hole, and thus the electrical conductor is entirely housed within the insulating body of the plug or socket and is proof against exposure. In conventional plugs and sockets with replaceable overcurrent-protection device, where a door cover is used to shield and close said overcurrent-protection device, the door cover in use is frequently deformed and then falls off to expose electrical conductor as due, for example, to change of temperature and the exertion of external force. On the contrary, it is not possible for the safety latch means according to this invention of falling off after it is inserted into the plug or socket body, and thus a high degree of safety is assured. When the plug or socket of this invention is in use, i.e. when the prong members or contact blades of the plug or socket are connected to a power supply, the safety latch means is resistant to becoming loose and falling off and in no way causes the overcurrent-protection device to become loose and fall off or to cause the electrical conductor to become exposed. In this invention, the replaceable overcurrent-protection device can be conveniently fitted, removed and replaced without the need of any tool. The plug or socket of this invention is simple in structure and low cost to manufacture, and can become a popular product with extensive applications.

It is noted that the insulating body of the plug or socket according to this invention includes the structure of an upper body shell and a lower body shell assembled together by fastening means such as screws, rivets or adhesive or other bonding techniques, which are well-known and in common use, thus detailed description thereof is omitted.

BRIEF DESCRIPTION OF THE DRAWINGS

FIG. 1 illustrates a first embodiment of the electrical plug according to this invention, in which, FIG. 1A is a schematic elevational view of the plug embodiment, FIG. 1B is a longitudinal sectional view through the plug of FIG. 1A, FIG. 1C is a sectional view taken along the line 1C—1C of FIG. 1B, and FIG. 1D is an end view of the plug of FIG. 1A as seen from the prong side.

FIG. 2 illustrates a second embodiment of the electrical plug according to this invention, in which, FIG. 2A is a schematic elevational view of the plug embodiment, FIG. 2B is a longitudinal sectional view through the plug of FIG. 2A, FIG. 2C is a sectional view taken along the line 2C—2C of FIG. 2B, and FIG. 2D is a sectional view taken along the line 2D—2D of FIG. 2B.

FIG. 3 illustrates a third embodiment of the electrical plug according to this invention, in which, FIG. 3A is a schematic elevational view of the plug embodiment, FIG. 3B is a longitudinal sectional view through the plug of FIG. 3A, FIG. 3C is a sectional view taken along the line 3C—3C of FIG. 3B, and FIG. 3D is a sectional view taken along the line 3D—3D of FIG. 3B.

FIG. 4 illustrates a fourth embodiment of the electrical plug according to this invention, in which, FIG. 4A is a schematic elevational view of the plug embodiment, FIG. 4B is a longitudinal sectional view through the plug of FIG. 4A, FIG. 4C is a sectional view taken along the line 4C—4C of FIG. 4B, and FIG. 4D is a sectional view taken along the line 4D—4D of FIG. 4B.

FIG. 5 illustrates a fifth embodiment of the electrical plug according to this invention, in which, FIG. 5A is a schematic elevational view of the plug embodiment, FIG. 5B is a longitudinal sectional view through the plug of FIG. 5A, FIG. 5C is a sectional view taken along the line 5C—5C of FIG. 5B, and FIG. 5D is a sectional view taken along the line 5D—5D of FIG. 5B.

FIG. 6 illustrates a sixth embodiment of the electrical plug according to this invention, in which, FIG. 6A is a schematic elevational view of the plug embodiment, FIG. 6B is a longitudinal sectional view through the plug of FIG. 6A, FIG. 6C is a sectional view taken along the line 6C—6C of FIG. 6B, and FIG. 6D is a sectional view taken along the line 6D—6D of FIG. 6B.

FIG. 7 illustrates a seventh embodiment of the electrical plug according to this invention, in which, FIG. 7A is a schematic elevational view of the plug embodiment, FIG. 7B is a longitudinal sectional view through the plug of FIG. 7A, FIG. 7C is a sectional view taken along the line 7C—7C of FIG. 7B, and FIG. 7D is a sectional view taken along the line 7D—7D of FIG. 7B.

DETAILED DESCRIPTION OF THE PREFERRED EMBODIMENTS

Figure 1:
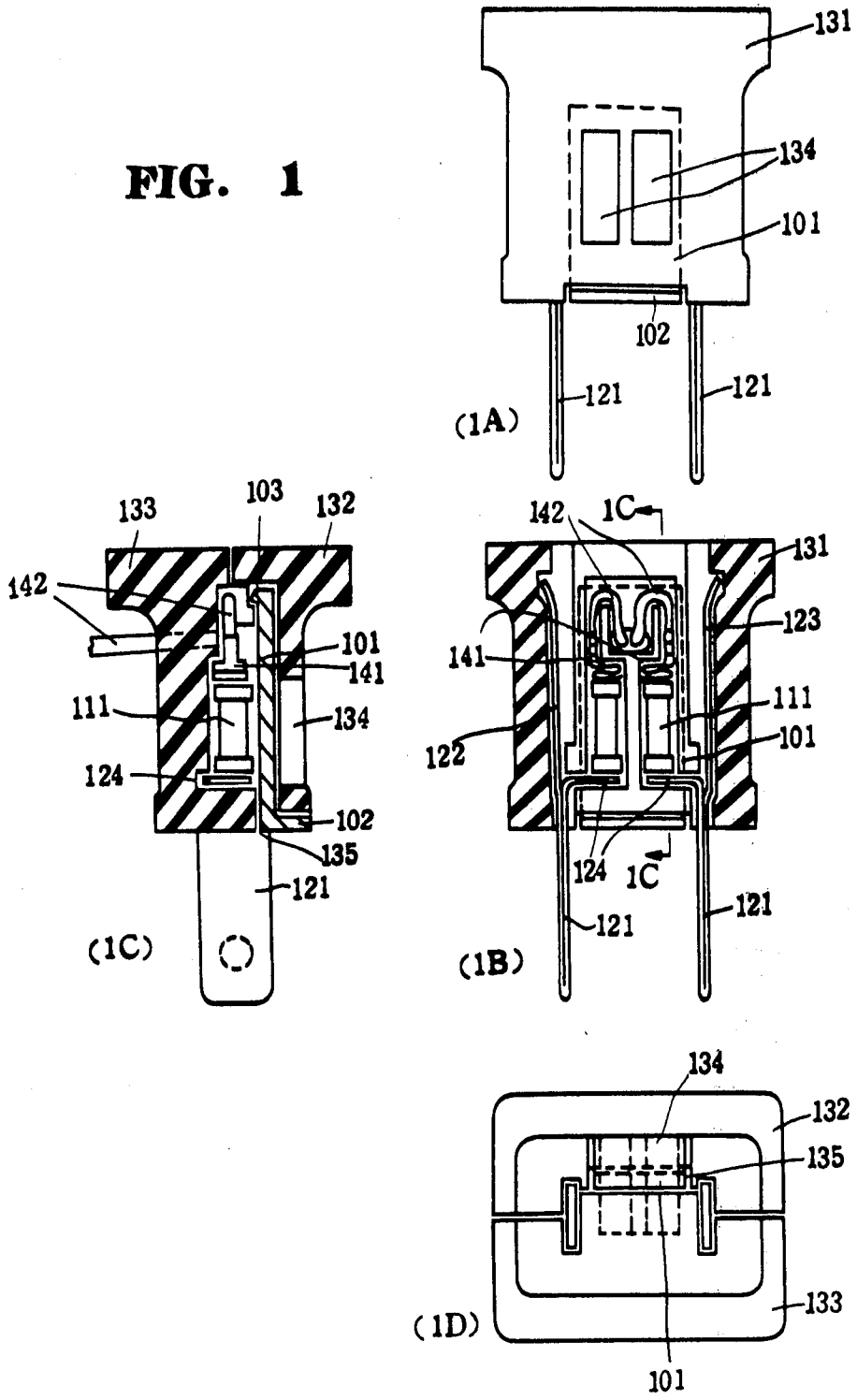

Referring to the drawings, the external details of a first embodiment of the fused electrical plug as illustrated in FIG. 1 includes a plug body 131 having a pair of forwardly projecting conducting prong members 121, 121. The rear face of plug body 131 may include a pair of add-on plug slots (not shown) which are adapted to receive the prongs (not shown) of a second plug thereby connecting the prongs of the second plug to the base portions 122, 123 of the prong members 121, 121 of the fused plug, as is known in the art. However, it is not necessary for the fused plugs of this embodiment and of other various embodiments according to this invention as described hereinafter to be capable of receiving an add-on plug.

As shown in FIG. 1, the plug body 131 comprises an upper body shell 132 and a lower body shell 133. The upper and lower body shells 132 and 133 are made of insulating material and are combined to define an interior chamber for receiving the base portions 122, 123 of the prong members 121, 121, respectively connection contacts 124, 124 branching from the base portion 122, 123 respectively, and connection terminals 141, 141, as may best be seen in FIG. 1B. On the upper body shell 132 of the plug body 131, there are provided a pair of openings 134, 134 passing through the shell wall into the chamber defined by the upper and lower body shells, such that a pair of overcurrent-protection devices 111, which may be two fuses having desired current ratings, can be inserted through the openings 134, 134 into the chamber for disposition between the connection terminals 141 and the connection contacts 124 and thus complete the electrical connection therebetween (See FIG. 1B). In a manner similar to a conventional one, electrical conductor wires 142 are connected to the connection terminals 141 via a hole (not shown) through the lower body shell 133, as may be seen in FIG. 1C.

Referring to FIG. 1C and FIG. 1D, at the front face of the plug body 131, there is an opening 135 defined by the upper and lower body shells 132 and 133. Through the opening 135, a safety latch means including a plate-shaped latch member 101 with end flange 102 is adapted to be inserted into the chamber within the plug body 131 causing its end flange 102 to be flush with the front face of the plug body, such that the openings 134, 134 of the upper body shell 132 are closed by the latch member 101 as shown in FIG. 1C, and as shown by broken line in FIG. 1A. Thus, when the latch member 101 is inserted into position after the overcurrent-protection devices 111 have been fitted, it serves to close the openings 134, 134 and thus prevents access to the overcurrent-protection devices 111 therethrough. The latch member 101 also serves to hold the overcurrent-protection devices in proper position. When the replacement of the overcurrent-protection devices is desired, the latch member 101 is removed in the direction in which the prong members 121, 121 insert into a mating socket of a power source (not shown), and then the overcurrent-protection device is removed and a new one is substituted therefor via the related opening 134.

It is preferred that the length of the latch member 101 is greater then that of the portion of the prong member 121 projecting outside the plug body 131. In this case, the latch member 101 can be removed from the plug body only if the prong members of the plug have been entirely separated from the socket of the power source into which the plug has been inserted for normal operation. That is to say, the replacement of the overcurrent-protection device can not be effected unless the plug is entirely separated from a live circuit. This feature assures the safety of the user. And also, it is preferred that the inner end of the latch member 101 is provided with an engaging means such as a projection 103 for engaging and anchoring within the plug body for securing same in position.

Figure 2:
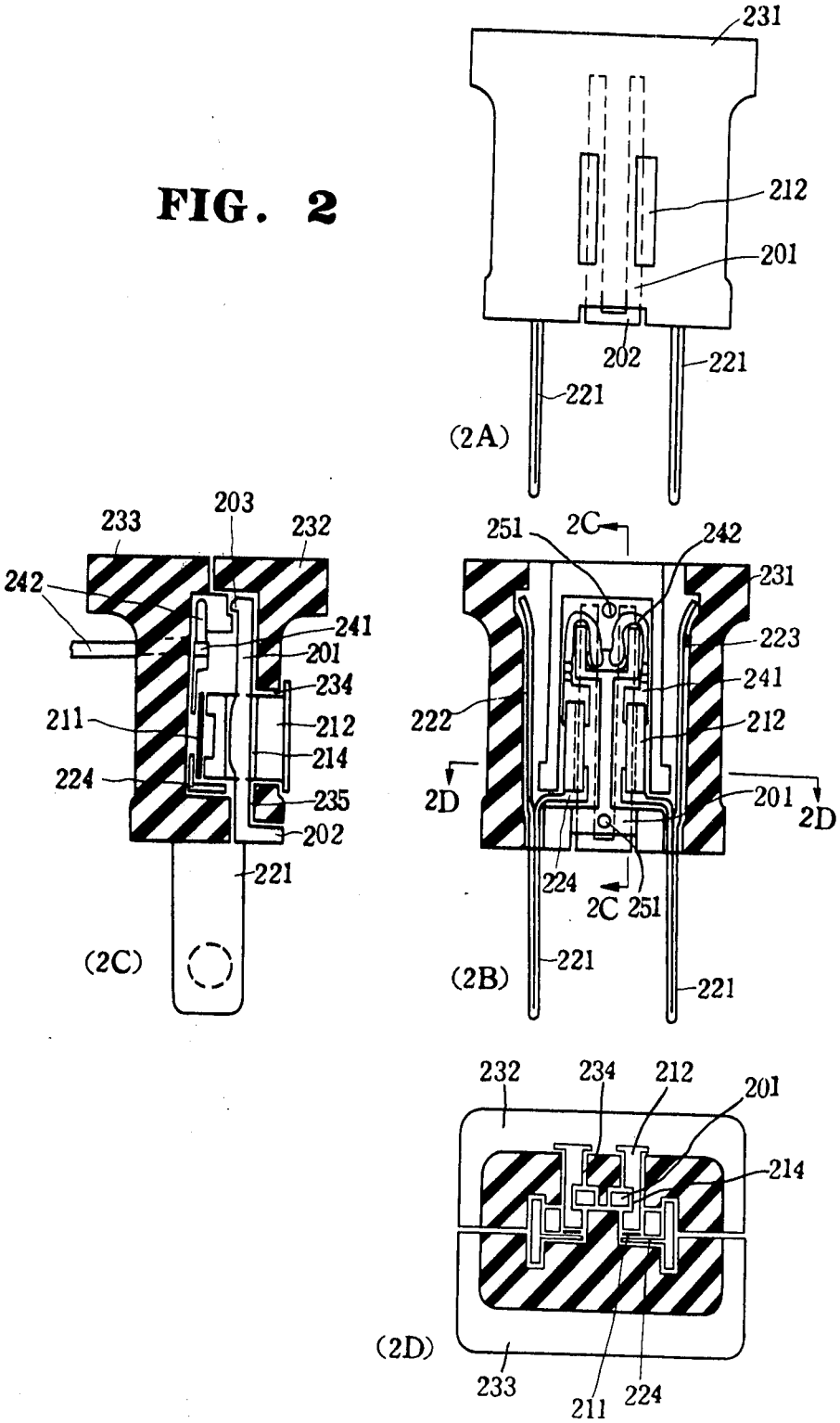

Now turning to FIG. 2, there is shown a second embodiment of the electric plug of this invention. The second embodiment is similar to the embodiment shown in FIG. 1 except the arrangement and the structure of the overcurrent-protection device and the latch member. The parts of the plug of FIG. 2 corresponding to those of FIG. 1 are indicated by the same last two numerals with the first numeral being a "2" instead of "1", and the description of these similar parts is omitted for simplification.

As best shown in FIG. 2C, the overcurrent-protection device 211 is carried by a base 212 which is adapted to be fitted into the opening 234 to a position having the overcurrent-protection device bridging across the gap between the connection contact 224 and the connection terminal 241 so as to complete the electrical connection therebetween. The latch member 201 is of forked shape or of U-shape as shown by broken line in FIG. 2A. When the U-shaped latch member 201 is fitted into position, the legs of the U-shaped latch member 201 respectively snugly pass through the slots 214 formed in the side face of the bases 212, 212 of the overcurrent-protection devices and thus firmly engage with the bases 212 and hold the overcurrent-protection devices in position. Thus the openings 234, 234 of the upper body shell 232 are blocked and shut by the bases 212 of the overcurrent-protection devices 211, and access to the overcurrent-protection devices 211 from outside is prevented.

It is noted that, as in the second embodiment, the forked shape or U-shape of the latch member 201 is particularly suitable for a plug in which the upper and lower body shell of the plug body are assembled by means of screws or rivets 251 on the center line of the plug body as shown.

Figure 3:
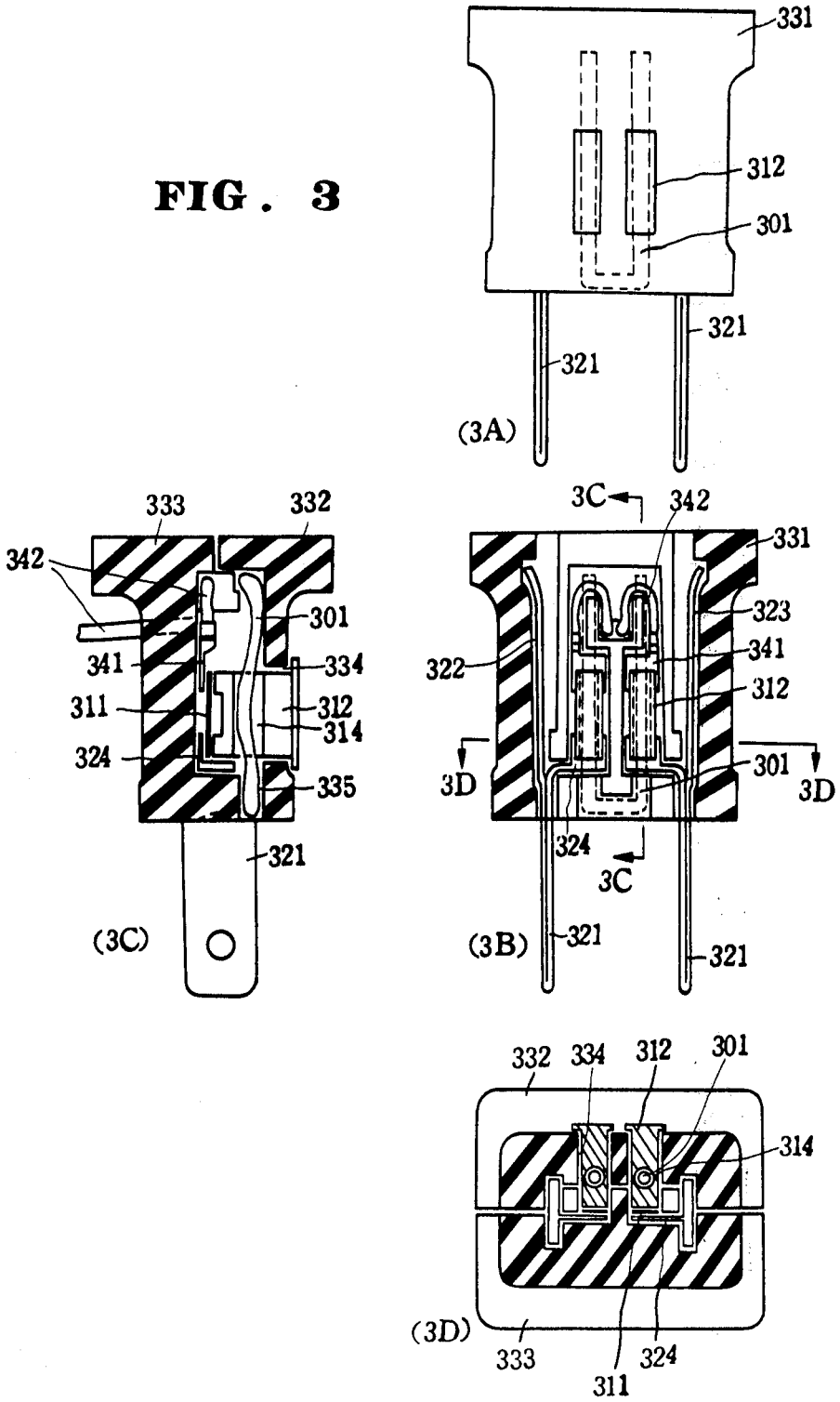

FIG. 3 illustrates a third embodiment of the plug of this invention which is similar to the second embodiment shown in FIG. 2 except for the arrangement and the structure of the overcurrent-protection device 311 and the latch member 301. The parts of the plug of FIG. 3 corresponding to those of FIG. 2 are represented by the same last two numerals with the first numeral being "3" instead of "2", and the description of these similar parts is omitted for simplification.

As shown by broken line in FIG. 3A, the latch member 301 is of forked shape or U-, the legs of which are circular or cylindrical in section as seen in FIG. 3D. When the latch member 301 is fitted into position, the legs thereof, pass through openings or holes 314, 314 formed in the bases 312 of the overcurrent-protection devices and the legs of the U-shaped latch member 301 are each heat in a suitable manner as shown in FIG. 3C so as to engage with the bases 312 and hold the overcurrent protection devices firmly against the related connection terminal 341 and connection contact 324 to complete the circuit. This arrangement also serves to prevent the accidental removal of the overcurrent-protection devices 311.

Figure 4:
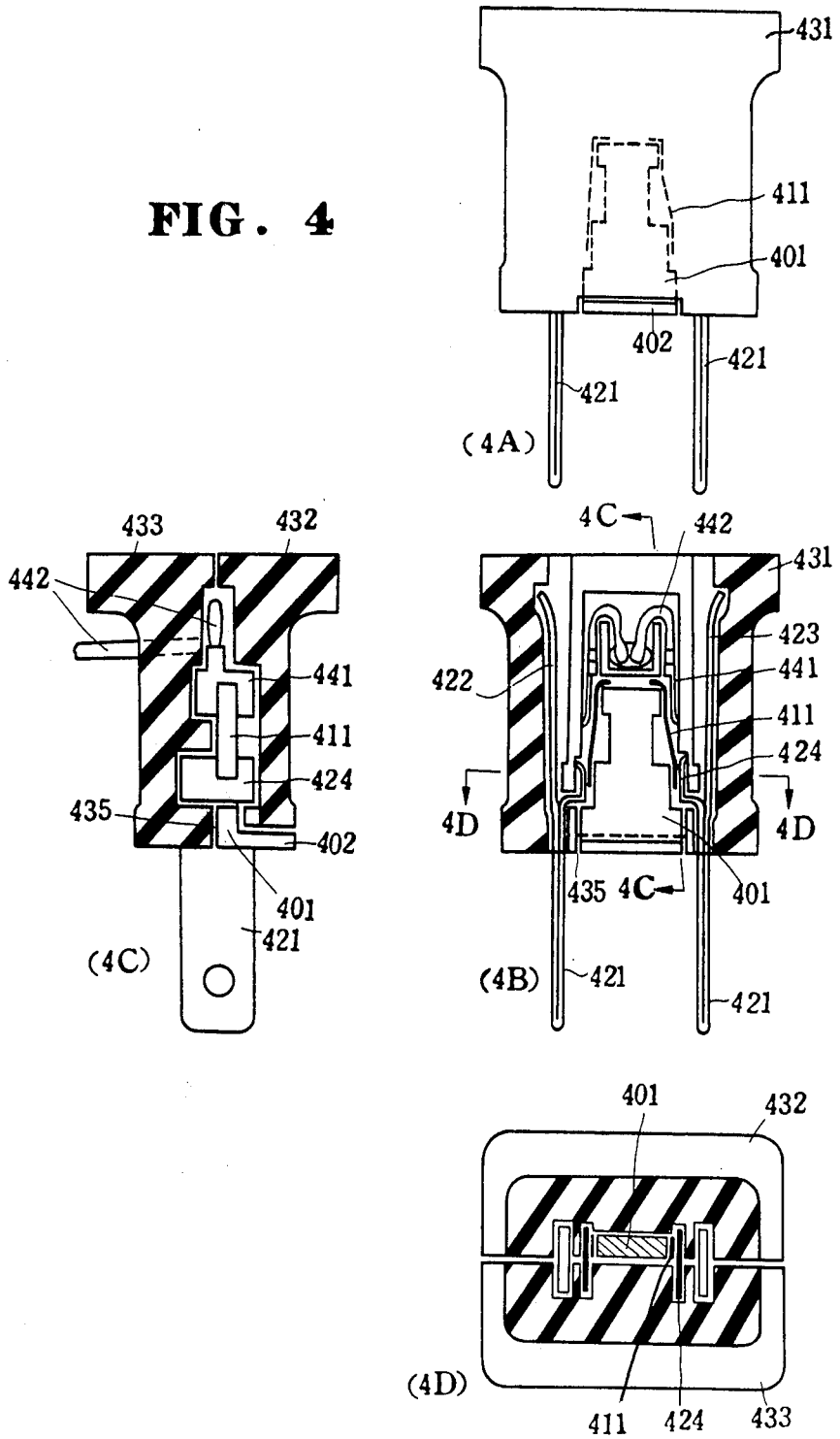

FIG. 4 illustrates a fourth embodiment of the plug of this invention which is similar to the first embodiment shown in FIG. 1 except for some modifications in the arrangement and the structure of the overcurrent-protection device and the latch member. The parts of the plug of FIG. 4 corresponding to those of FIG. 1 are indicated by the same last two reference numerals with the first numeral being a "4" instead of a "1", and the description of these similar parts is omitted. In the fourth embodiment, there is no need to provide openings in the lateral side of the upper or lower body shell 432 or 433 respectively for fitting and removing the overcurrent-protection device 411. As best shown in FIG. 4B, the overcurrent-protection devices 411, which may be two fuse links of desired current ratings, are carried by the latch member 401. The latch member 401 is formed with projecting shoulder portions which are opposite to the connection terminals 441 and connection contacts 424 when the latch member 401 is fitted into position, and the overcurrent-protection devices are adapted to bridge the shoulder portions on either side of the latch member 401. When the latch member 401 carrying the overcurrent-protection devices is fitted via the opening 435 into position as shown in FIG. 4B, the overcurrent-protection devices will be pressed against the connection terminals 441 and the connection contacts 424 and be maintained in electrical contact therewith by the shoulder portions of the latch member 401 to complete the circuit. The fourth embodiment represents a high degree of safety by the absence of the openings through the lateral side of the plug. While the two overcurrent-protection devices are provided on a single latch member 401 as shown in this embodiment, it is also possible to provide two latch members each carrying one overcurrent-protection device for facilitating the replacement of one overcurrent-protection device in case only one overcurrent-protection device is blown.

Figure 5:
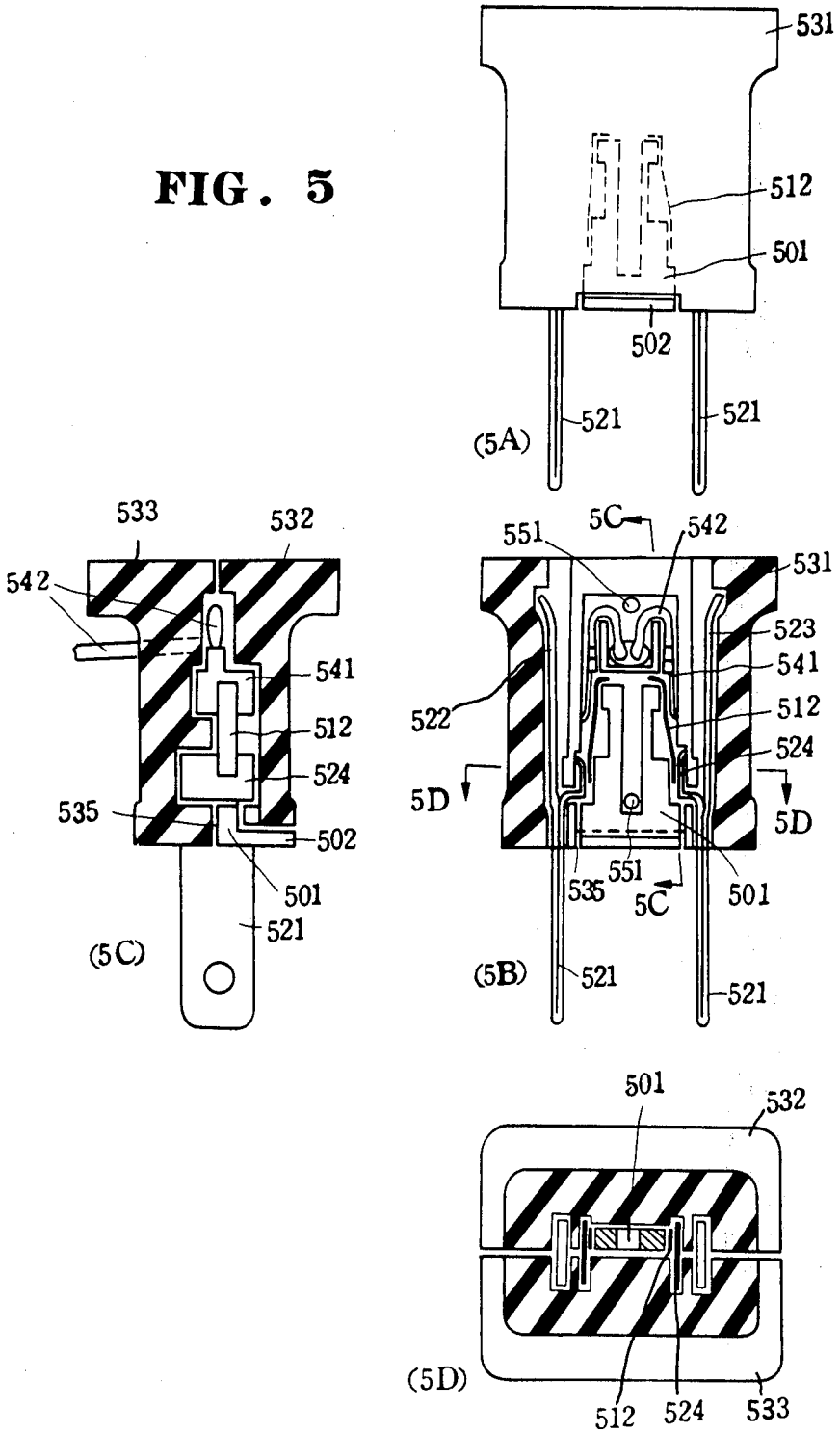

FIG. 5 illustrates a fifth embodiment of the plug of this invention which is substantially identical to the plug shown in FIG. 4. The only difference resides in that the latch member 501 is forked to assume a general U-shape as best seen in FIGS. 5A and 5B instead of an integral plate shape, and as mentioned above, such forked or U-shaped configuration of the latch member is particularly suitable for a plug in which the upper and lower body shell of the plug are assembled by means of screws or rivets 551 on the center line of the plug body and the screws or rivets 551 pass through the space between the forked segments of the latch member 501 as shown.

Figure 6:
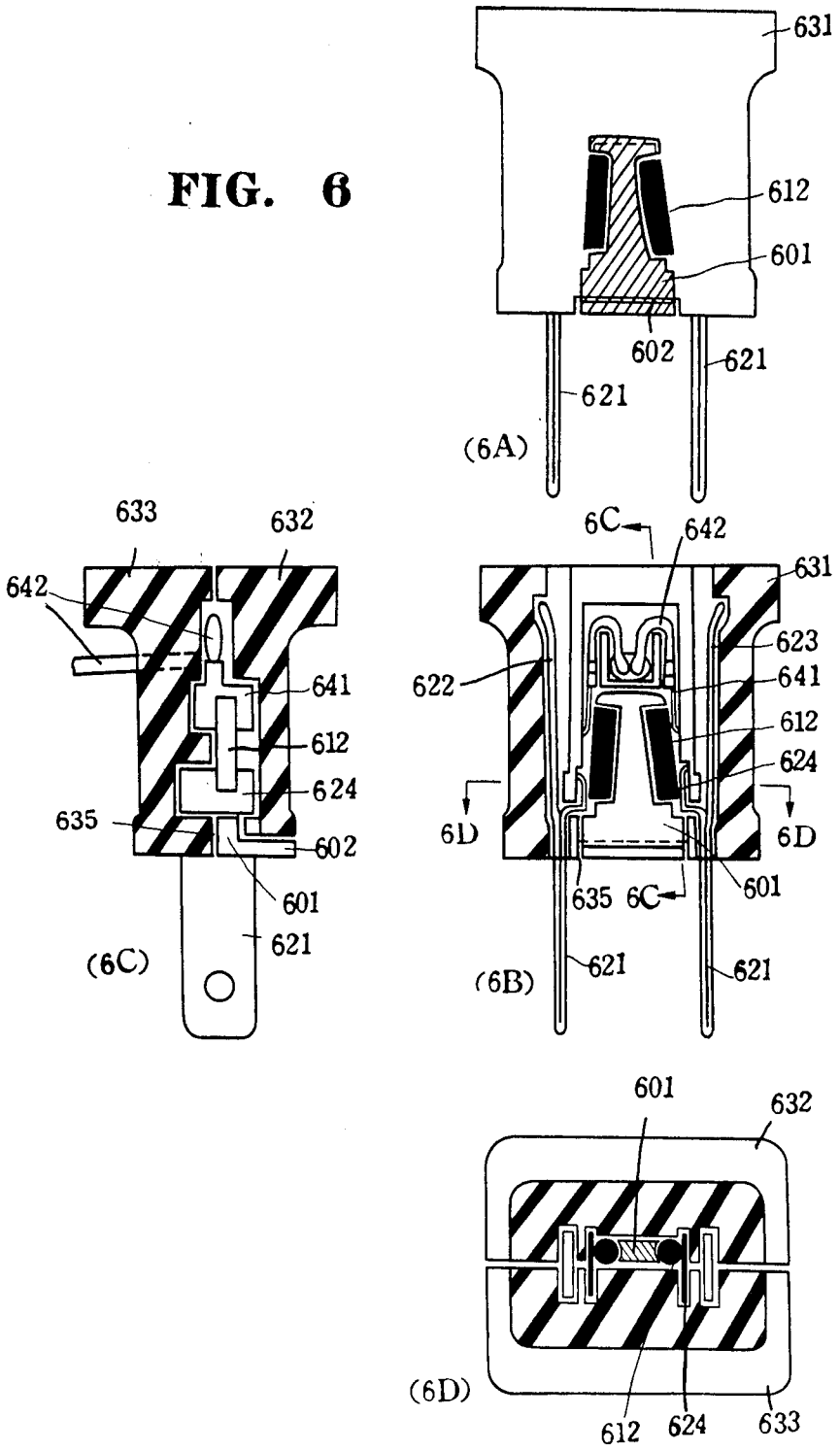

Turning to FIG. 6, there is shown a sixth embodiment of the plug of this invention which is substantially identical to the plug shown in FIG. 4. The only difference is that the overcurrent-protection devices 612 are received in the gap defined by the shoulder portions on either side of the latch member 601, instead of bridging the gap. Such arrangement modification causes the latch member 601 to accommodate the structure and shape of the overcurrent-protection devices.

It should be noted that, although the latch members in the embodiments of FIGS. 4–6, inclusive are illustrated as having a length equal to about two thirds of the longitudinal length of the insulating body, the length of the latch member may, if desired, be equal to that of the longitudinal length of the insulating body, as hereinafter described with reference to FIG. 8.

Figure 7:
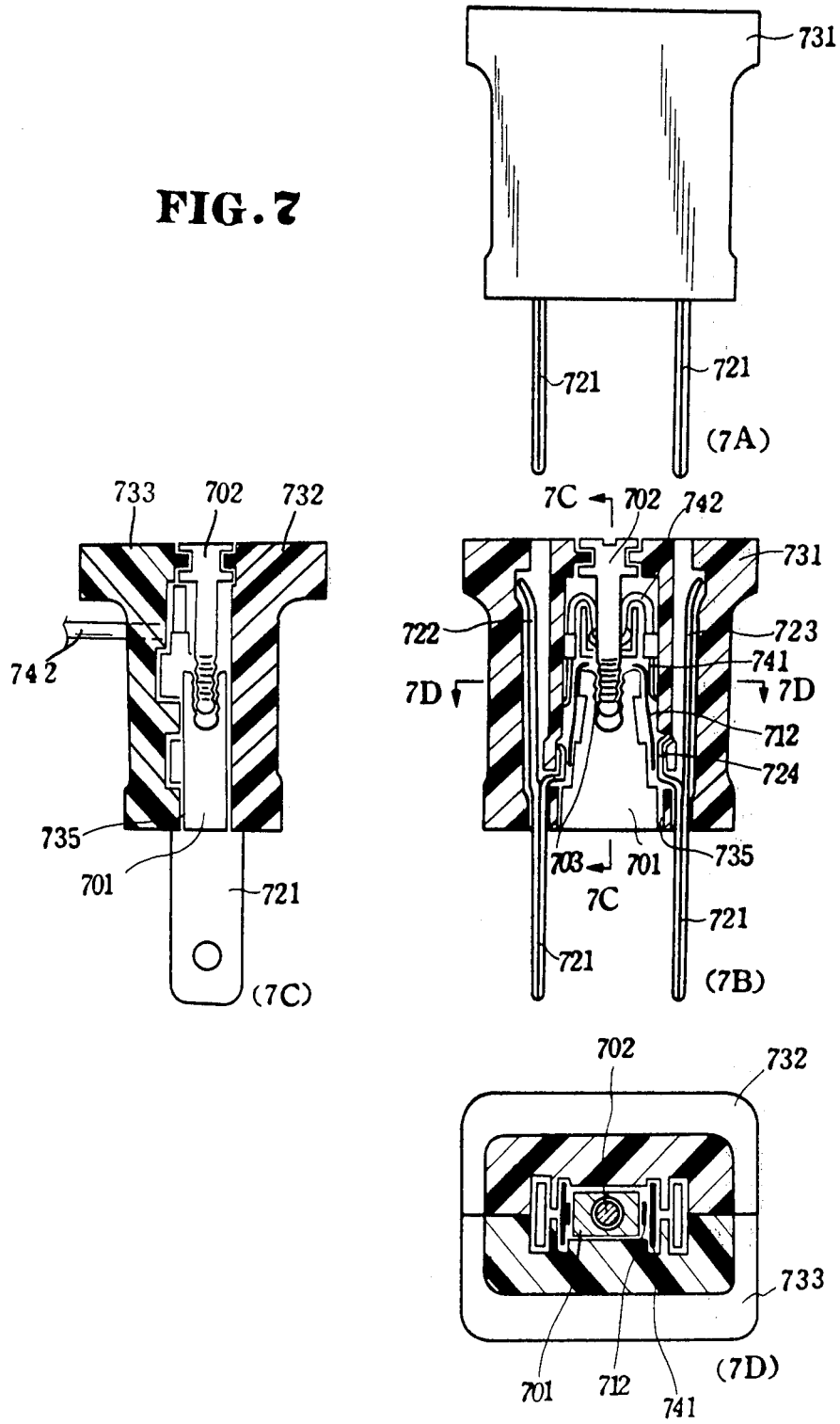

Referring to FIG. 7, there is shown a seventh embodiment of the plug of this invention which is substantially similar to the plug shown in FIG. 4. The difference resides in that, in this embodiment particular engaging means are provided for holding the latch member 701 in position. As shown in FIGS. 7B–7D, the engaging means include a tapped hole 703 provided in the latch member 701 and extending along the longitudinal axis of the plug, and an externally-threaded rod member 702 adapted for engagement within the tapped hole 703 of the latch member 701; the externally-threaded rod member 702 having its head end attached on the wall of the rear end of the plug body 731. During assembling, the latch member 701 carrying a pair of fuse links 712 is inserted into the opening 735 with the tapped hole 703 registering with the inner end of the externally-threaded rod member 702. The externally-threaded rod member 702 is turned relative to the latch member 701, as by a screw-driver for example, so as to bring the latch member 701 into fixed position.

Figure 8:
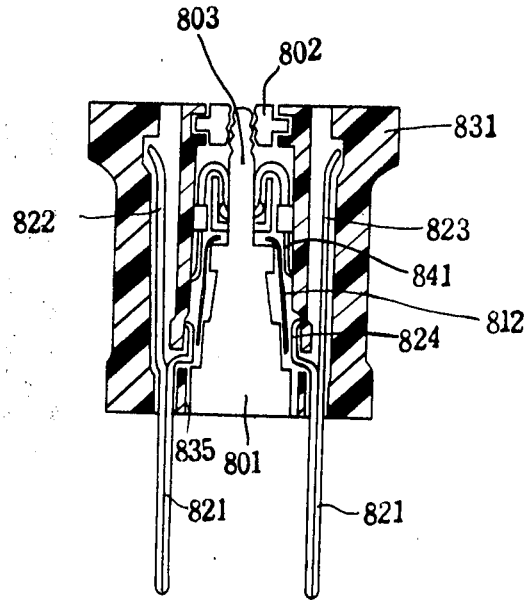
FIG. 8 illustrates, in longitudinal sectional view, an eighth embodiment of the electrical plug according to this invention.

Referring to FIG. 8, there is shown an eighth embodiment of the plug of this invention which is substantially identical to the plug shown in FIG. 7. The difference resides in that, the engaging means include an externally-threaded rod member 803 provided on the latch member 801 and extending along the longitudinal axis of the plug, and a nut member 802 is attached on the wall of the rear end of the plug body 831 and is provided with a tapped hole adapted to engage with the externally-threaded rod member 803. During assembly of the plug of this embodiment, the latch member 801 carrying a pair of fuse links 812 is inserted into the opening 835 with the externally-threaded rod member 803 of the latch member 801 registering with the tapped hole of the nut member 802, and the nut member 802 is then turned relative to the latch member 801 so as to bring the latch member 801 into fixed position.

Although in the above-illustrated various embodiments, this invention is embodied as a plug, it should be understood that this invention may be embodied as a socket also. The socket embodiments of this invention are similar to those illustrated and described with reference to FIGS. 1–8, inclusive, with the only modification being that the insulating body includes a pair of contact blades within the interior chamber of the insulating body instead of a pair prong members projecting outside the insulating body, and the front face of the insulating body includes a pair of slots which are adapted to receive the prongs of a normal plug thereby connecting the latter to the contact blades within the insulating body of the socket of this invention. In this case, similarly, it is preferred that the length of the latch member be greater than that of the prongs of the normal plug to be mated in order to assure that the replacement of the overcurrent-protection device can be effected only if the socket of this invention has been entirely separated from the mating, normal plug.

As various modifications could be made in the electrical connection device, i.e., plug or socket, herein described and illustrated without departing from the scope of the invention, it is intended that all matter contained in the foregoing description or shown in the accompanying drawings shall be interpreted as illustrative rather than limiting.

I claim:

1. In an electrical connection device constituting a plug and having an insulating body, a pair of electrical conductors entering said insulating body and terminating in respective connection terminals, a pair of connection electrodes for defining a pair of prongs extending from a forward end of said insulating body to be connected to a mating device and apertures in said forward end of said body through which said prongs extend for connection thereof to said mating device at said forward end of said insulating body, replaceable overcurrent-protection device means positioned within said insulating body and connecting each of said connection terminals to a corresponding one of said connection electrodes to complete an electric circuit, and at least one opening into said insulating body for fitting and removing the overcurrent-protection device means, the improvement comprising safety latch means including at least one latch member adapted to be inserted into said insulating body from said forward end thereof to hold the overcurrent-protection device means in position and to close each said opening for thereby preventing access to the overcurrent-protection device means, the direction in which the latch member is removed from said insulating body being thereby the same as the direction in which said connection device is connected to said mating device, whereby the removal of the latch member and the replacement of the overcurrent-protection device can be effected only if said connection device has been separated from said mating device, the overcurrent-protection device means defining an opening and the latch member being adapted to provide interengagement with the last-said opening to hold the overcurrent-protection device in position within said insulating body.

2. In an electrical connection device constituting a plug and having an insulating body, a pair of electrical conductors entering said insulating body and terminating in respective connection terminals, a pair of connection electrodes for defining a pair of prongs extending from a forward end of said insulating body to be connected to a mating device and apertures in said forward end of said body through which said prongs extend for connection thereof to said mating device at said forward end of said insulating body, replaceable overcurrent-protection device means positioned within said insulating body and connecting each of said connection terminals to a corresponding one of said connection electrodes to complete an electric circuit, and at least one opening into said insulating body for fitting and removing the overcurrent-protection device means, the improvement comprising safety latch means including at least one latch member adapted to be inserted into said insulating body from said forward end thereof to hold the overcurrent-protection device means in position and to close each said opening for thereby preventing access to the overcurrent-protection device means, the direction in which the latch member is removed from said insulating body being thereby the same as the direction in which said connection device is connected to said mating device, whereby the removal of the latch member and the replacement of the overcurrent-protection device can be effected only if said connection device has been separated from said mating device, the overcurrent-protection device means being provided with a slot and the latch member being of plate shape adapted to provide side edge engagement with the slot to hold the overcurrent-protection device means in position within said insulating body.

3. In an electrical connection device constituting a plug and having an insulating body, a pair of electrical conductors entering said insulating body and terminating in respective connection terminals, a pair of connection electrodes for defining a pair of prongs extending from a forward end of said insulating body to be connected to a mating device and apertures in said forward end of said body through which said prongs extend for connection thereof to said mating device at said forward end of said insulating body, replaceable overcurrent-protection device means positioned within said insulating body and connecting each of said connection terminals to a corresponding one of said connection electrodes to complete an electric circuit, and at least one opening into said insulating body for fitting and removing the overcurrent-protection device means, the improvement comprising safety latch means including at least one latch member adapted to be inserted into said insulating body from said forward end thereof to hold the overcurrent-protection device means in position and to close each said opening for thereby preventing access to the overcurrent-protection device means, the direction in which the latch member is removed from said insulating body being thereby the same as the direction in which said connection device is connected to said mating device, whereby the removal of the latch member and the replacement of the overcurrent-protection device can be effected only if said connection device has been separated from said mating device, the overcurrent-protection device means being provided with a slot and the latch member being of forked shape adapted to engage the slot by the side edge of a forked segment of the latch member to hold the overcurrent-protection device means in position within said insulating body, said insulating body including upper and lower body shells assembled by fastening means passing through the space between forked segments of the latch member.

4. In an electrical connection device constituting a plug and having an insulating body, a pair of electrical conductors entering said insulating body and terminating in respective connection terminals, a pair of connection electrodes for defining a pair of prongs extending from a forward end of said insulating body to be connected to a mating device and apertures in said forward end of said body through which said prongs extend for connection thereof to said mating device at said forward end of said insulating body, replaceable overcurrent-protection device means positioned within said insulating body and connecting each of said connection terminals to a corresponding one of said connection electrodes to complete an electric circuit, and at least one opening into said insulating body for fitting and removing the overcurrent-protection device means, the improvement comprising safety latch means including at least one latch member adapted to be inserted into said insulating body from said forward end thereof to hold the overcurrent-protection device means in position and to close each said opening for thereby preventing access to the overcurrent-protection device means, the direction in which the latch member is removed from said insulating body being thereby the same as the direction in which said connection device is connected to said mating device, whereby the removal of the latch member and the replacement of the overcurrent-protection device can be effected only if said connection device has been separated from said mating device, the overcurrent-protection device means being provided with an aperture therethrough and the latch member being of circular cross-section adapted to pass through the last-said aperture to hold the overcurrent-protection device means in position within said insulating body.

5. The electrical connection device of any of claims 1, 2, 3 or 4 wherein the latch member is provided with engaging means for engagement with structure within said insulating body for preventing the accidental removal of the latch member from said insulating body.

6. An electrical connection device of any of claims 1, 2, 3 or 4 and further characterized by said connection device constituting also a socket, said pair of connection electrodes comprising also a pair of contact blades within said insulating body, said insulating body including a pair of slots in its rearward end opposite from said forward end for receiving in said slots the prongs of a mating plug for contact with respective ones of said contact blades.

7. An electrical connection device of any of claims 1, 2, 3 or 4 and further characterized by the length of said latch member being greater than the length of said prongs whereby removal of said latch member and replacement of said overcurrent-protection device means can be effected only upon complete withdrawal of said prongs from said mating socket.

* * * * *